United States Patent [19]

Tripp

[11] 4,112,711

[45] Sep. 12, 1978

[54] DIRECT-FROM-SKEIN YARN FEEDER

[76] Inventor: Luther W. Tripp, 937 Campus, Redlands, Calif. 92373

[21] Appl. No.: 774,979

[22] Filed: Mar. 7, 1977

[51] Int. Cl.[2] ..... D04B 33/00

[52] U.S. Cl. ..... 66/1 A; 242/129.5; 242/141

[58] Field of Search ..... 66/4, 1 A, 125 R; 242/134, 130, 141, 129.5

[56] References Cited

U.S. PATENT DOCUMENTS

| | | | |
|---|---|---|---|
| 1,666,216 | 4/1928 | Mowat | 242/141 |
| 2,246,713 | 6/1941 | Benson | 242/141 |
| 2,254,468 | 9/1941 | Benson | 242/141 |
| 2,275,545 | 3/1942 | Miller | 242/141 X |
| 2,410,018 | 10/1946 | D'Arcy | 242/141 |
| 2,491,585 | 12/1949 | Sammons | 242/141 |
| 3,420,468 | 1/1969 | Rhoades | 242/141 X |
| 3,764,086 | 10/1973 | Garzonio | 242/141 X |

FOREIGN PATENT DOCUMENTS

| | | | |
|---|---|---|---|
| 569,791 | 6/1945 | United Kingdom | 242/130 |

*Primary Examiner*—Mervin Stein
*Assistant Examiner*—Andrew M. Falik

[57] ABSTRACT

A flat circular base having a ball bearing, comprising co-planar inner and outer races, the outer race of which is co-axially mounted on said base, the inner race of said bearing supporting a tubular skein holding mast having a circular sheet masonite platform fixed thereon in close spaced relation with said base. A skein of yarn assembled about a given axis is applied axially to said mast so that the skein and mast freely rotate as the yarn is used in crocheting or knitting. The mast is hollow and also provides a storage receptacle for crocheting needles.

4 Claims, 2 Drawing Figures

10
35
34
32
19
33
36
25
31
20
22
26
27
28
21
18
13
11
16
16
14
15
29
30
17
12

2
35
19
38
10
37
26
15
16
11
2

DIRECT-FROM-SKEIN YARN FEEDER

SUMMARY OF THE INVENTION

From ancient times the practice has been followed by manual crocheters or knitters of converting each skein of yarn purchased for this use into ball form before using it manually in fabricating a garment.

It is an object of the present invention to eliminate this bit of drudgery by providing a yarn feeder by use of which the fabricating operation can be performed with yarn taken directly from the skein as the latter comes from the manufacturer.

Another object is to provide such a yarn feeder which may be made and profitably sold at a reasonable price and which is handy to use and store and carry from place to place with crocheting and knitting materials.

A further object is to provide such a yarn feeder which embodies a suitable means for storing crocheting needles.

DETAILED DESCRIPTION OF THE PREFERRED EMBODIMENT

Figure 2:
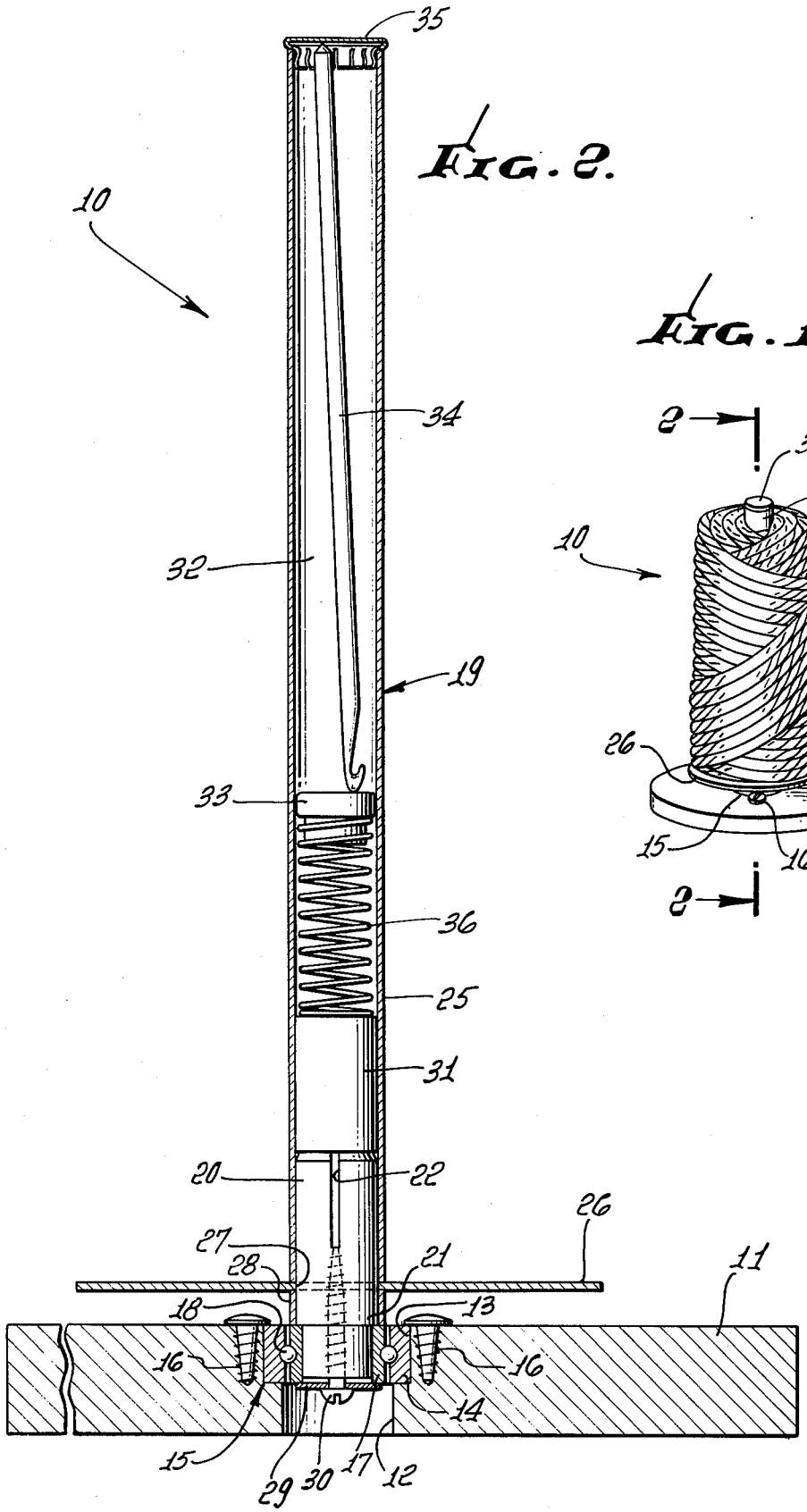
FIG. 2 is an enlarged full scale vertical sectional view taken on the line 2—2 of FIG. 1 and illustrating how crocheting needles may be readily stored within the hollow mast of the device.

The invention comprises a yarn feeder 10 having a base 11 preferably formed of a disc, about 7 inches in diameter, of sheet pressed wood about ¾ of an inch thick. Formed centrally in the base is a bore 12 having a counterbore 13 which snugly receives the outer race 14 of a ball bearing 15 so that the upper end of the bearing lies flush with the upper surface of the base. Screws 16 bear against the upper end of the outer bearing race 14 to retain the bearing in counterbore 13. The bearing 15 has a co-planar inner race 17 which is rotationally suspended within the outer race 14 by balls 18. Mounted co-axially on the inner race 17 is a feeder mast 19 which includes a wooden plug 20 which is turned down at its lower end so as to snugly fit into inner race 17 and form an annular shoulder 21 which fits against the upper end of the inner race 17.

The upper end of plug 20 has a diametral saw kerf 22 enabling this plug to be readily inserted into or removed from the bottom end of a cylindrical tube 25 which is comprised in the mast 19. A relatively thin disc 26 preferably about 4 inches in diameter and made of masonite, has a central hole 27 which closely fits the plug 20 and is held assembled therewith by a collar 28 of approximately the same wall thickness and inside diameter as the tube 25 and which is pressed onto the plug 19 so as to bear against the upper end of the inner bearing race 17 when the device is assembled and clamp the disc 26 against the lower end of tube 25. The plug 20 is held in rigidly assembled relation with the inner bearing race 17 by a washer 29 placed against the lower end of the inner race 17 and secured to the plug 20 by a wood screw 30 which is inserted upwardly through said washer and screwed into a suitably prepared hole formed axially in the plug 20.

A short plug 31 is pressed into the lower end of tube 25 by the plug 20 to permanently close the bottom end of a free space 32 provided thereabove in said tube.

As thus assembled on the mast 19, the disc 26 forms a skein supporting platform which lies in a plane normal to the mast and parallel with the base 11.

The hollow space 32 in the mast 19 is adaptable to various uses and is shown in FIG. 2 as being equipped with an upwardly spring biased floor 33 for yieldably supporting crocheting needles 34 so that these are always pressed upwardly against a metal cap 35 normally closing the upper end of tube 25 so that when cap 35 is removed, the floor 33 will lift the needles 34 upwardly above the upper end of the tube thereby giving an opportunity to select a needle from the group of these stored in mast 19. The floor 33 is thus biased upwardly by a coil spring 36 resting on top of the wooden plug 31.

OPERATION

Figure 1:
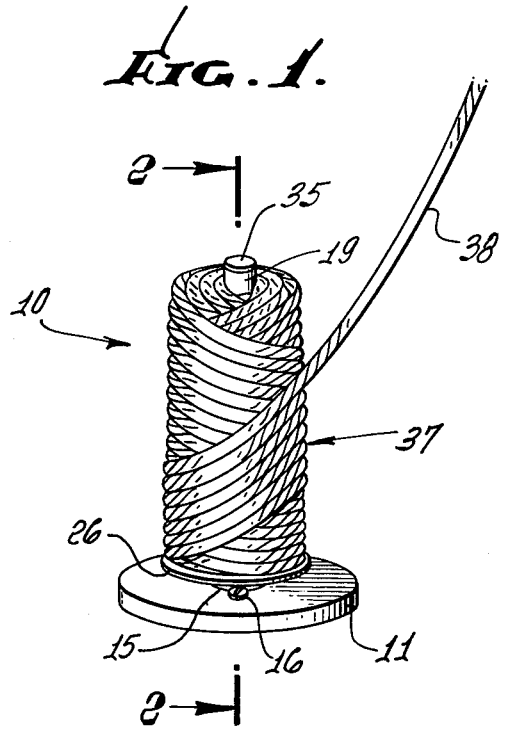
FIG. 1 is a perspective view of a preferred embodiment of the invention illustrating the use of this in drawing yarn directly from a skein fitted on the mast of the feeder.

In operating the feeder 10 a type of skein 37 is selected in which the yarn has been assembled in the factory producing the same so as to be wound about a central axis. To prepare this skein for application to the mast 19 of the feeder 10, the knitter extends an index finger from each hand axially into one of the two ends of the skein so as to divide the yarn about the same axis on which the skein was formed until the index fingers come together in the middle of the skein. The skein thus held between the hands is placed in alignment with the mast 19 and the latter used to replace one of the fingers in the skein while the other finger is held in alignment with the mast so that the skein 37 is transferred from the index fingers of the two hands to the mast 19 substantially as shown in FIG. 1. The outer end of the yarn 38 of the skein 37 thus applied to the mast 19 is then loosened from the skein so that the yarn 38 may be readily unwound from the skein by pulling on the yarn so as to rotate the skein 37 and the mast 19 on which it is mounted. With the skein 37 thus mounted on the yarn feeder 10 and the yarn strand 38 freed for unwinding from the skein, this latter action takes place automatically as the yarn is incorporated in a piece of knitting or crochet work being assembled by the operator. It is thus seen that by the use of the yarn feeder 10, the old practice of transferring the yarn from the manufacturer's skein to a ball before starting to use the yarn in knitting or crocheting is rendered unnecessary.

The diametral kerf 22 in plug 20 enables the tube 25 to be readily pulled off of this as when storing or shipping the feeder 10. The secondary plug 31 remains permanently in place closing the bottom end of space 32 in the mast 19 when the latter is thus disassembled.

I claim:

1. A direct-from-the-skein yarn feeder comprising:
   - a base comprising a circular flat block of pressed wood or the like, having a central bore and a counterbore;
   - a bearing on said base, said bearing comprising a radial ball bearing with co-planar inner and outer races, said outer race fitting in said counterbore;
   - a skein mounting mast, said mast comprising a cylindrical tube, the lower end whereof having inserted upwardly therein a wooden plug which also fits downwardly into said inner race and thereby journals in said bearing;
   - a skein supporting platform fixed on said mast near the lower end thereof, said mast and platform freely rotating with a skein mounted thereon as yarn is withdrawn from said skein;

means for securing said inner race to said plug;

means for securing said outer race rigidly to said base; and a short tubular collar of approximately the same inside diameter as said tubular mast fitting said plug so as to itself rest on the upper end of said inner bearing race, said platform being formed of thin sheet material and having a central hole with the same inside diameter as said tubular mast, said platform fitting said plug and being assembled thereon between said mast and said collar so as to be snugly gripped between said mast and said collar and said inner race when said plug is assembled as aforesaid on said inner race.

2. A yarn feeder as recited in claim 1 wherein said mast is tubular in character and is provided with a cap and has a spring biased floor therein for supporting crocheting needles within said mast so that said needles are automatically extended upwardly out of the upper end of said mast when said cap is removed during a crocheting operation so as to permit access to said needle storage means in said mast during a crocheting operation without interferring with the latter.

3. A yarn feeder as recited in claim 1 wherein said mast may be slipped off of said plug for shipping said feeder; and a secondary wooden plug pressed into the lower end of said mast just above said first recited plug to permanently close the bottom of said mast when the latter is slipped off said first plug.

4. A yarn feeder as recited in claim 3 wherein a diametral kerf is provided in an upper portion of said first recited plug to impart pliability thereto and thus facilitate said mast being slipped off of and back onto said plug.

* * * * *